US006722356B2

(12) United States Patent
Distaso

(10) Patent No.: US 6,722,356 B2
(45) Date of Patent: Apr. 20, 2004

(54) GAS BURNER VALVE ASSEMBLY

(75) Inventor: Alessandro Distaso, Gemonio (IT)

(73) Assignee: Whirlpool Corporation, Benton Harbor, MI (US)

( * ) Notice: Subject to any disclaimer, the term of this patent is extended or adjusted under 35 U.S.C. 154(b) by 192 days.

(21) Appl. No.: 10/054,722

(22) Filed: Jan. 22, 2002

(65) Prior Publication Data

US 2003/0136395 A1 Jul. 24, 2003

(51) Int. Cl.[7] ..... F24C 3/12

(52) U.S. Cl. ..... 126/39 N; 126/214 R; 137/883; 285/197; 251/145

(58) Field of Search ..... 126/39 N, 39 R, 126/211, 214 R, 214 C; 137/883, 861, 884; 285/197; 251/145, 170, 86

(56) References Cited

U.S. PATENT DOCUMENTS 2,450,744 A * 10/1948 Whithead ..... 126/39 N
3,574,338 A * 4/1971 Shelor ..... 239/553.3
3,870,348 A * 3/1975 Hawkins ..... 285/197
3,872,888 A * 3/1975 Porter ..... 137/883
4,913,183 A * 4/1990 Vogel et al. ..... 285/197
5,311,895 A * 5/1994 Martin ..... 137/883
5,979,430 A * 11/1999 Peed et al. ..... 126/39 N
6,202,639 B1 * 3/2001 Wu ..... 126/39 N

FOREIGN PATENT DOCUMENTS

EP 0 834 698 A * 4/1998
GB 1026000 A * 4/1966

* cited by examiner

*Primary Examiner*—Josiah Cocks
(74) *Attorney, Agent, or Firm*—John T. Colligan; Robert O. Rice; Stephen D. Krefman

(57) ABSTRACT

The invention relates to a gas valve of the type commonly used to connect a circular or non-planar gas manifold to the burner of a household cooktop. An adapter is provided for converting the gas valve for use with a non-planar profile gas manifold to a planar profile gas manifold.

25 Claims, 4 Drawing Sheets

GAS BURNER VALVE ASSEMBLY

BACKGROUND OF THE INVENTION

1. Field of the Invention

The invention relates to a gas valve of the type commonly used in a household cooktop. More specifically, the invention relates to a gas valve having a manifold adapter capable of mounting manifolds of different cross-sectional shapes or profiles to the gas valve.

2. Description of the Related Art

Most common household gas cooktops whether alone or in a range comprise multiple burners that are selectively supplied gas from a gas manifold through a valve assembly. The valve assembly includes a separate valve for each of the burners, with the valves being arranged linearly along either the face or rear of the cooktop. The manifold connects each of the valves of the valve assembly to a source of gas, such as natural gas or propane.

The manifold is typically elongated and has a hollow interior through which the gas flows. The valve includes an inlet stem that extends upwardly and away from a manifold seat formed in the valve. The stem includes an inlet opening through which the gas from the manifold can enter and be distributed by the valve to the corresponding burner. The manifold is received within the manifold seat of the valve in a sealing relationship to prevent the escape of gas at the interface of the manifold and the valve. When the manifold is seated upon the valve, the stem extends into the interior of the manifold to provide a flow path for the gas to pass from the manifold and into the valve.

There is no international standard for the cross-sectional shape or profile of the manifold. For example, in the United States, the manifold will usually have a rectangular cross-section or profile, normally a square, with one of the faces of the rectangle contacting the manifold seat. In Europe, the manifold will usually have a circular cross-section or profile, with an arc segment of the circular profile contacting the manifold seat of the valve.

There is also no international standard for the shape of the valve seat profile. Typically, the valve used in a product is selected to correspond to the manifold standard where the cooktop is anticipate to be sold. Thus, valves intended for use with a U.S. manifold will typically have a valve seat with a planar profile whereas valves intended for use with a European manifold will typically have a valve seat with an arcuate profile.

The non-standardization of the manifold profile creates the problem that a cooktop manufactured for the European market is not readily usable for the U.S. market without replacing the European valve assembly and manifold with a U.S. valve assembly and manifold. As the market for home appliances, including cooktops, transforms from national or regional markets into an international market, the need to make a U.S. specific or a European specific cooktop unnecessarily increases the complexity and costs of the manufacturing process and inventory costs. Therefore, there is the need to provide a cooktop with a valve assembly and manifold that can be easily reconfigured for any market without completely replacing the entire valve assembly and/or manifold.

SUMMARY OF THE INVENTION

The invention relates an adapter for coupling a gas valve having a manifold seat with a first profile to a gas manifold having a contact surface with a second profile, which is different from the first profile. The gas valve includes a gas inlet stem extending upwardly from the manifold seat. The manifold has an opening in the contact surface.

The adapter comprises a body having an upper surface and a lower surface. The lower surface has a first portion with a profile that is shaped to correspond to the first profile of the gas valve manifold seat. The upper surface having a manifold seat with a profile that is shaped to correspond to the second profile of the manifold contact surface. A stem is located in the manifold seat of the upper surface and extends therefrom to terminate in an upper end. A passage extends through the body and has an inlet opening formed in the stem and an outlet opening formed in the first portion. The adapter couples the manifold to the valve by the first portion of the adapter lower surface being seated on the valve manifold seat and the manifold contact surface being seated on the manifold seat of the adapter upper surface.

Preferably, the profile of the first portion is non-planar and the profile of the manifold seat is planar. It is preferred that the non-planar profile is arcuate and that the manifold has a rectangular cross-section defined by multiple faces, with one of the multiple faces forming the planar profile.

The passage outlet is preferably adapted to mate with the gas inlet. Therefore, the passage outlet is generally sized to receive a stem extending from the valve and in which is defined the gas inlet for the valve to thereby effect the mating of the passage outlet and the gas inlet.

The stem preferably has an elongated shape that defines a longitudinal axis. The passage has a first portion that is aligned with the longitudinal axis. The passage can also include a lateral portion extending from the first portion to the exterior of the stem, with the intersection of a lateral portion and the first portion defining the passage inlet.

A tapped opening can be formed in the upper end of the stem for receiving a mechanical fastener to connect the adapter to the manifold. The stem can have a height such that the upper end of the stem abuts a portion of the manifold when the manifold is seated on the adapter manifold seat. The tapped opening can also form an upper portion of the passage.

The adapter can further comprise a gasket that encircles the stem and is in abutting relationship with the adapter seat so that the gasket is compressed between the manifold and the adapter when the manifold is seated to effect a seal therebetween.

The adapter body can further comprise at least one mounting tab extending from the body with an opening formed therein through which a fastener can be passed to secure the body to the valve when the adapter seated on the valve.

In another aspect, the invention relates to a cooktop comprising a burner having an inlet and an outlet for dispensing gas to generate a cooking flame. The cooktop also includes a valve comprising an outlet coupled to the burner inlet, a manifold seat with a first profile, and an inlet opening formed in the valve manifold seat. A manifold is provided for supplying gas to the valve and having a contact surface with a second profile and in which is formed an outlet opening.

The cooktop further comprises an adapter comprising a body having an upper surface and a lower surface. The lower surface has a first portion with a profile that is shaped to correspond to the first profile of the gas valve manifold seat. The upper surface having a manifold seat with a profile that is shaped to correspond to the second profile of the manifold contact surface. A stem is located in the manifold seat of the upper surface and extends therefrom to terminate in an upper end. A passage extends through the body and has an inlet opening formed in the stem and an outlet opening formed in the first portion. The adapter couples the manifold to the valve by the first portion of the adapter lower surface being seated on the valve manifold seat and the manifold contact surface being seated on the manifold seat of the adapter upper surface.

Preferably, the profile of the first portion is non-planar and the profile of the manifold seat is planar. It is preferred that the non-planar profile is arcuate and that the manifold has a rectangular cross-section defined by multiple faces, with one of the multiple faces forming the planar profile.

DESCRIPTION OF THE PREFERRED EMBODIMENT

Figure 1:
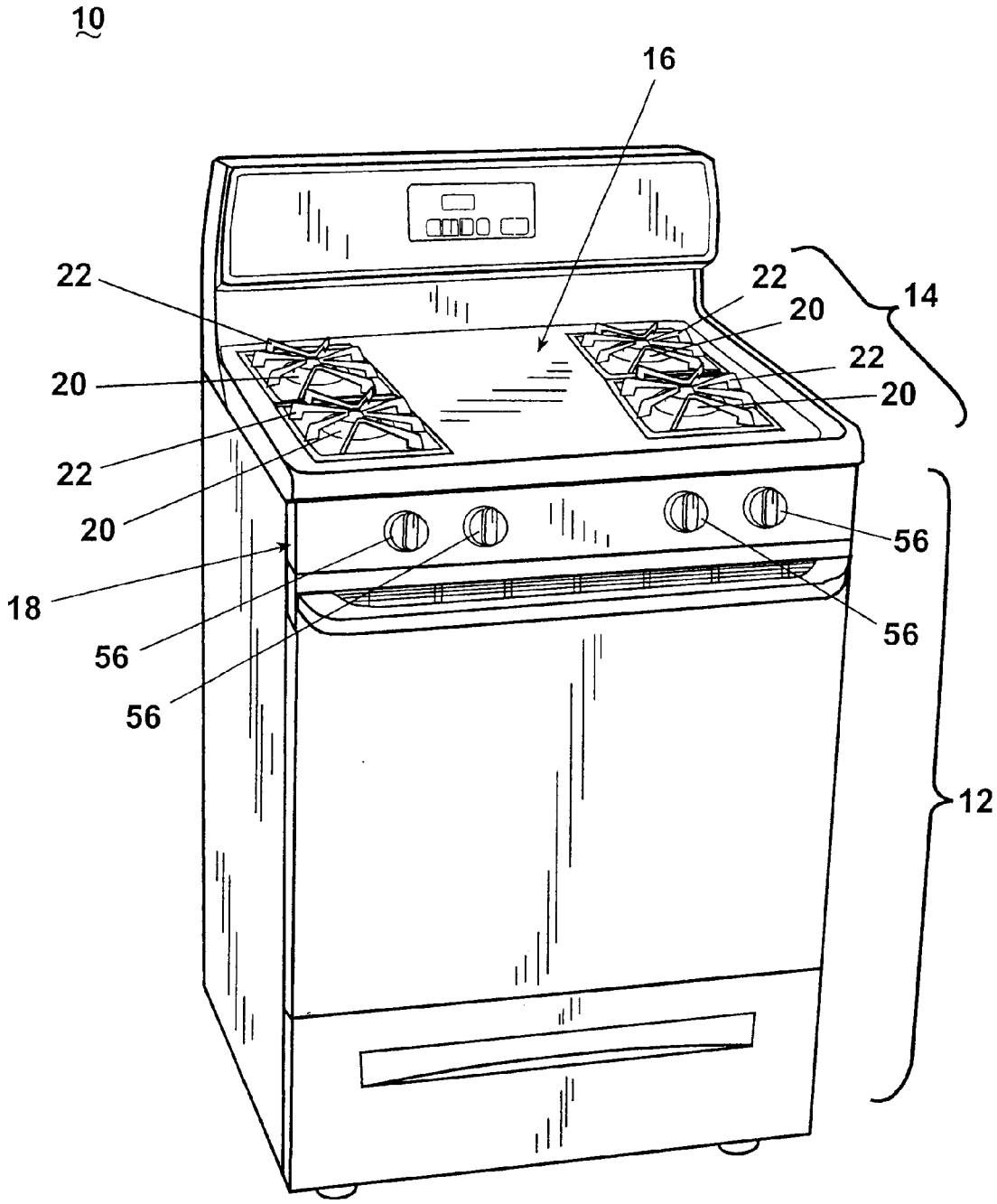
FIG. 1 is a perspective view of a combination oven and cooktop with a gas outlet with an adapter according to the invention.

FIG. 1 illustrates a stand-alone range 10 comprising an oven 12 in combination with a cooktop 14 according to the invention. The oven 12 is not germane to the invention and merely illustrates the cooktop 14 in one of many traditional appliance configurations. Therefore, the oven 12 will not be described in further detail. It should be noted that the cooktop 14 incorporating the invention need not be limited to the specific appliance configuration of a range 10. The range 10 is but one of many possible configurations. Cooktops are known to be sold as separate units or in combination with other appliances, such as the oven illustrated in the range 10.

The cooktop 14 comprises a top panel 16 and a front panel 18. Multiple burners 20 are provided on the top panel 16. Each of the burners 20 typically has a corresponding grate 22 for supporting a pan above the burner 20.

Figure 2:
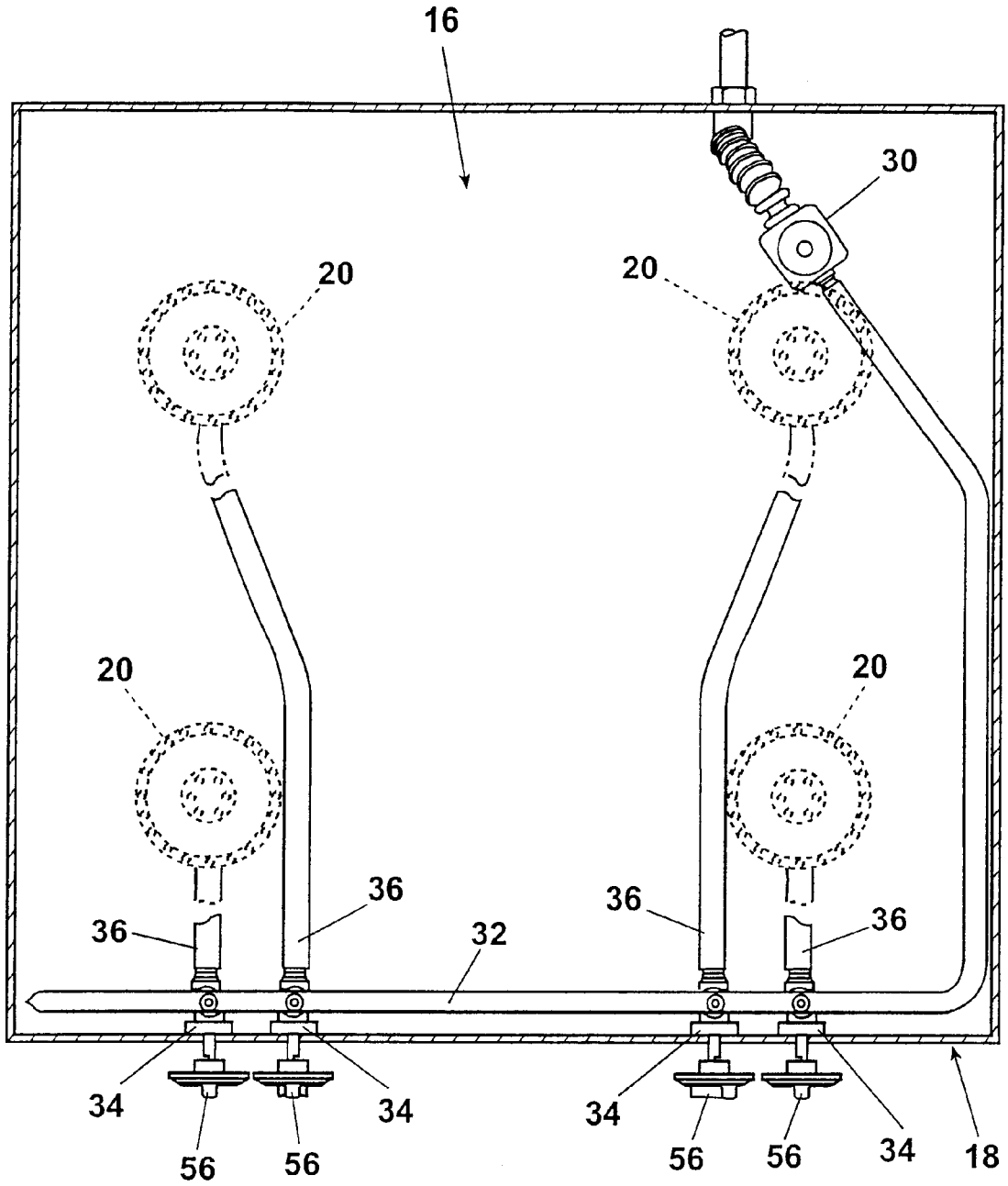
FIG. 2 is a schematic top view of the cooktop of FIG. 1 and illustrating the burners, valve assembly, and manifold of the cooktop, with portions of the cook top shown in phantom for clarity.

Referring to FIGS. 1 and 2, the cooktop 14 comprises a gas distribution system for delivering gas, generally natural gas or propane, from a gas supply 30 to the burners 20. The gas distribution system includes a gas manifold 32 that connects the gas supply 30 to multiple valves 34, which collectively can be thought of as a valve assembly. Each of the valves 34 is connected to a corresponding burner 20 by a gas distribution line 36.

Figure 3:
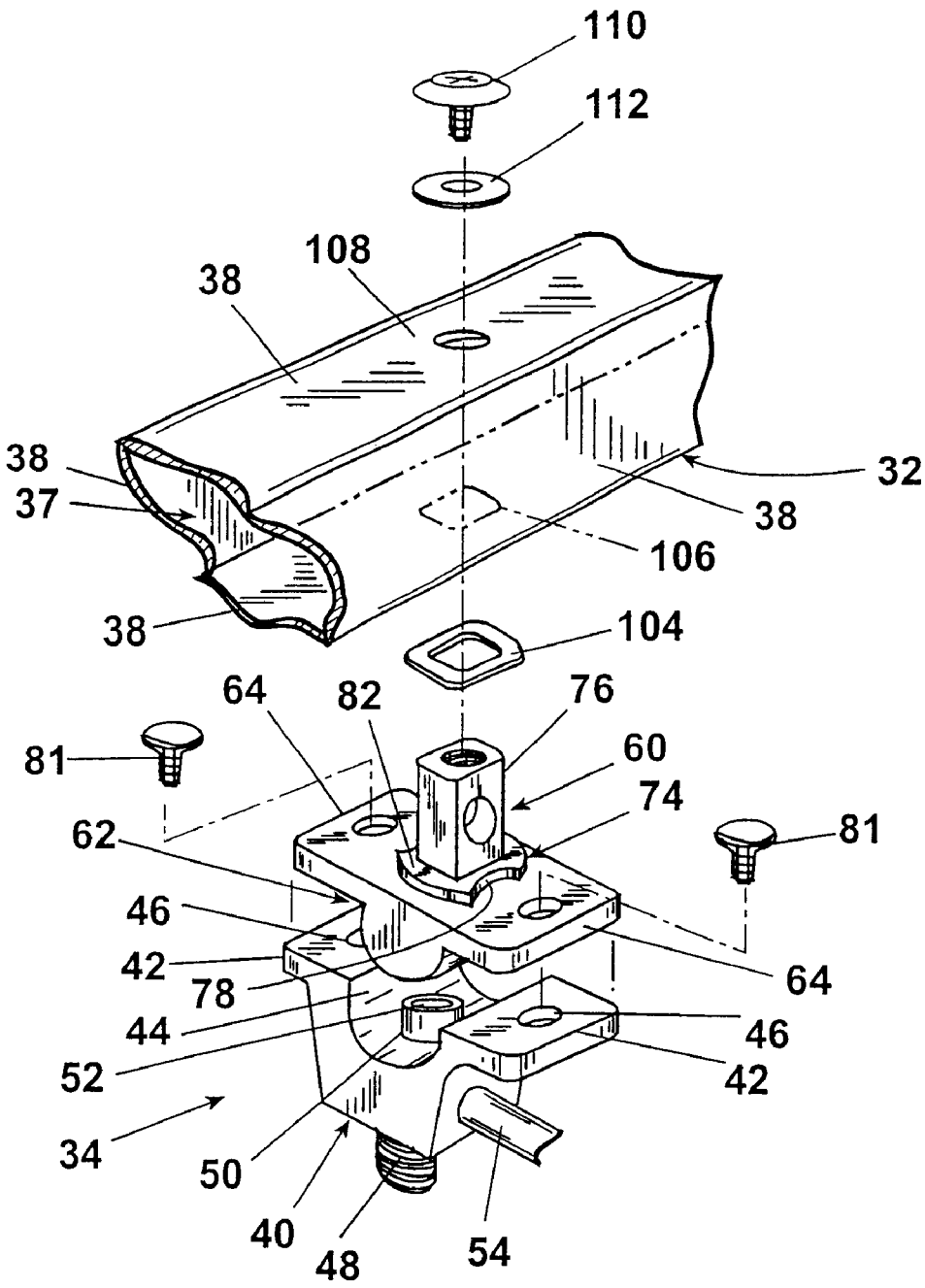
FIG. 3 is an exploded view of a valve, valve adapter, and manifold according to the invention.
Figure 4:
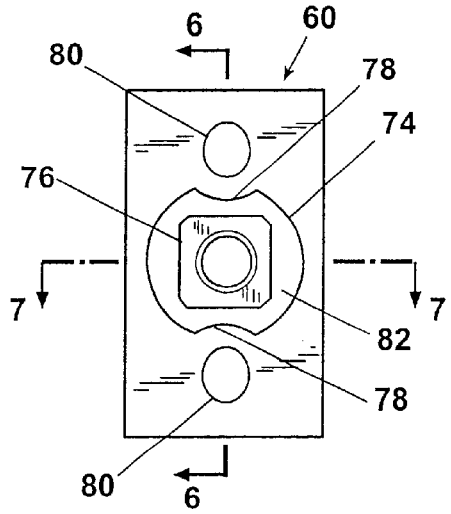
FIG. 4 is a top view of the valve adapter of FIG. 3.
Figure 5:
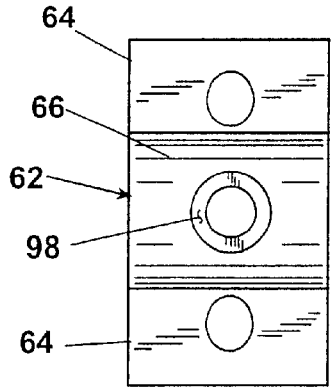
FIG. 5 is a bottom view of the valve adapter FIG. 3.
Figure 6:
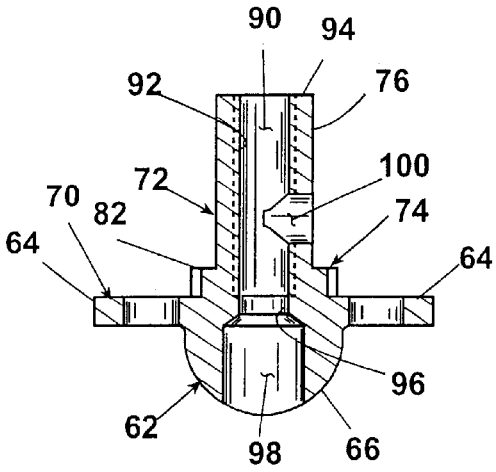
FIG. 6 is a sectional view taken along line 6—6 of FIG. 4.
Figure 7:
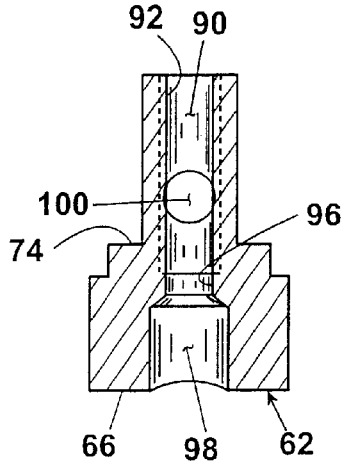
FIG. 7 is a sectional view taken along line 7—7 of FIG. 4.

Referring to FIGS. 2 and 3, the manifold 32 has a rectangular cross-section and defines a hollow interior 37. The rectangular manifold 32 has multiple faces 38. Each of the valves 34 comprises a valve body 40 having an upper surface 42 with an arcuate portion 44, which defines a valve seat. The upper surface 42 includes tapped openings 46. A gas outlet 48 extends from the body and couples with the distribution line 36 to supply gas to the corresponding burner 20. A cylindrical gas inlet stem 50 extends from the arcuate portion 44 of the upper surface and defines an internal passage within open end 52 through which gas can enter the valve body 40. Actuator shaft 54 extends laterally from the body and mounts a control knob 56.

The rotation of the control knob 56 opens and closes the valve to control the flow rate of gas from the manifold 32 to the corresponding burner 20 by controlling the flow rate of gas from the stem 50 to the gas outlet 48. The valves are normally mounted relative to the front panel 18 such that the actuator shaft 54 extends through the front panel 18 thereby permitting the control knobs 56 to be mounted exteriorly of the front panel 18.

Referring to FIGS. 3–8, an adapter 60 is provided to convert the arcuate manifold seat of the valve 34 into a planar valve seat for mounting the rectangular manifold 32. The adapter 60 comprises a non-planar lower surface 62 that is defined by a pair of opposed mounting tabs 64 and an arcuate projection 66. The lower surface 62 preferably conforms to the upper surface 42 of the valve 34. Thus, the arcuate projection 66 preferably complements and corresponds to the arcuate portion 44 of the upper surface 42.

The adapter 60 comprises a planar upper surface 70 opposite the lower surface 62. A gas inlet 72 extends upwardly from the planar upper surface 70. The inlet 72 comprises a base 74 and a stem 76. The base 74 is preferably circular in plan form (see FIG. 4) whereas the stem is preferably square-shaped in plan form, with rounded or beveled corners.

The base 74 includes notches 78 adjacent openings 80 that extend through the mounting tabs 64. The notches 78 provide clearance for the insertion of fasteners 81 used to secure the adapter 60 to the valve 34. The junction of the base 74 with the stem 76 forms a shelf or support surface 82.

An internal passage 90 extends through the adapter 60 and comprises multiple portions. A tapped portion 92 extends from upper end 94 of the stem 76 and into the base 74, where it transitions into a non-tapped portion 96, which connects the tapped portion 92 to a receiver portion 98. The lateral portion 100 extends from the side of the stem 76 and into the tapped portion 92.

The tapped portion 92 functions to receive a fastener 110 that passes through the manifold and is threaded into the tapped portion 92 to fixedly secured the adapter 60 to the manifold.

The function of the receiver portion 98 is to receive the gas inlet stem 50 of the valve when the adapter 60 is seated on the valve 34. Thus, the receiver portion 98 is generally sized to correspond to the size and shape of the gas inlet stem 50 of the valve 34. In this manner the receiver portion 98 mates with the gas inlet stem 50 of the valve to fluidly couple the adapter 60 with the valve 34.

The lateral portion 100 functions as the inlet to the passage 90. In a typical installation, a fastener will be threaded into the tapped portion 92 in securing the adapter 60 to the manifold 32 thereby closing the open end of the stem 76. Therefore, the lateral portion 100 is typically the only inlet to the passage 90. If an installation does not require a fastener threaded into the tapped portion, the tapped portion 92 can also function as an inlet opening for the passage 90.

The valve 34 is of the type that is currently commonly used to mount a manifold with a circular profile by directly seating the circular profile manifold in the arcuate portion 44 of the valve upper surface 42 and fastening a clamp to the valve body 40 to clamp the circular profile manifold to the valve body.

When the valve 34 is to be used with a rectangular profile manifold, such as the square profile manifold 32, the adapter 60 is mounted to the body 40 of the valve 34 and effectively transforms the non-planar arcuate manifold seat of the valve 34 into a planar manifold seat. In essence, the manifold seat of the valve 34 is replaced with the manifold seat of the adapter 60. The manifold seat of the adapter 60 is suitable for mounting a planar profile manifold while maintaining a fluid-tight seal therebetween.

In assembling the adapter 60 to the valve 34, the adapter 60 is oriented such that the arcuate projection 66 faces the arcuate portion 44 of the valve body upper surface 42 and the receiver portion 98 and fastener openings 80 are aligned with the gas inlet stem 50 and the fastener openings 46, respectively. The adapter 60 is then seated on the upper surface 42 of the valve 34 by the arcuate projection 66 being received within the arcuate portion 44 and the gas inlet stem 50 being inserted into the receiver portion 98 of the adapter passage 90. Fasteners 81 are then inserted through the aligned fastener openings 80, 42 and threaded into the tapped fastener openings 42 of the body 40 to secure the adapter to the valve body 40.

To mount the manifold 32 to the adapter 60, a gasket 104 is slid onto the gas inlet 72 until it rests upon the upper surface 64 while circumscribing the base 74. The gasket 104 is preferably of sufficient thickness so that it extends slightly above the support shelf 82. The manifold 32 is mounted to the adapter 60 such that the stem 76 is slidably received through an opening 106 in a lower face 38 of the manifold 32 until the lower face 38 rests upon or is positioned just above the support shelf 82. The lower face 38 functions as a contact face for the manifold and abuts the support shelf 82 when the manifold is seated on the adapter.

In this position, the upper end 94 of the stem 76 is closely adjacent the opposing face 38 of the manifold 32 and the tapped portion 92 of the passage 90 is aligned with an opening 108 formed in the upper face 38. A fastener 110 is inserted through the opening 108 and threaded into the tapped portion 92. Preferably, a gasket 112 is inserted between the fastener 110 and the opening 108. As the fastener 110 is threaded into the opening 108, the gasket 112 is compressed between the fastener and the upper face 38 of the manifold 32 to fluidly seal the opening 108. The continued threading of the fastener 110 also forces the lower face 38 against the support shelf 82 and the gasket 104 to also seal the lower opening 106 and fixedly retain the manifold 32 to the adapter 60 to complete the mounting of the planar face of the manifold to the valve with a non-planar manifold seat.

Although the adapter 60 is shown in the preferred form of converting an arcuate profile manifold seat into a planar profile manifold seat to enable the valve 34 to be used with a planar manifold instead of a circular manifold, the adapter 60 can be used to convert any valve with any type of non-planar seat for use with a planar manifold. In such an application, the arcuate projection 66 is replaced with a projection that corresponds to the shape of the seat in the valve.

It is also within the scope of the invention for the adapter to function in reverse. That is, the adapter would convert a valve with a planar manifold seat into a valve having an arcuate or non-planar manifold seat. In such an application, the lower surface of the adapter would be generally planar and the upper surface of the adapter would have the non-planar surface as desired. However, practical considerations may limit the use of such an adapter. In most cooktops, there is very little space between the valve and the top panel 16. Since the non-planar adapter seat would be cut into the adapter, it is possible that the adapter will need to be of sufficient thickness it will interfere with or raise the manifold a sufficient amount that the manifold interferes with the top panel. In other words, the adapter or manifold may no longer fit under the top panel without replacing or modifying the top panel, which is highly undesirable.

While the invention has been specifically described in connection with certain specific embodiments thereof, it is to be understood that this is by way of illustration and not of limitation, and the scope of the appended claims should be construed as broadly as the prior art will permit.

I claim:

1. An adapter for coupling a gas valve having a manifold seat with a first profile to a gas manifold having a contact surface with a second profile, different from the first profile, the gas valve includes a gas inlet extending upwardly from the manifold seat and the manifold having an opening in the contact surface, the adapter comprising:

a body having an upper surface and a lower surface, the lower surface having a first portion with a profile that is shaped to correspond to the first profile of the gas valve manifold seat, the upper surface having a manifold seat with a profile that is shaped to correspond to the second profile of the manifold contact surface;

a stem located in the manifold seat of the upper surface and extending therefrom to terminate in an upper end; and a passage extending through the body and having an inlet opening formed in the stem and an outlet opening formed in the first portion;

wherein the adapter couples the manifold to the valve by the first portion of the adapter lower surface being seated on the valve manifold seat and the manifold contact surface being seated on the manifold seat of the adapter upper surface.

2. The adapter according to claim 1 wherein the profile of the first portion is non-planar.

3. The adapter according to claim 2 wherein the profile of the manifold seat is planar.

4. The adapter according to claim 3 wherein the non-planar profile is arcuate.

5. The adapter according to claim 1 wherein the passage outlet is adapted to mate with the gas inlet.

6. The adapter according to claim 5 wherein the passage outlet is sized to receive a stem extending from the valve and in which is defined the gas inlet for the valve to thereby effect the mating of the passage outlet and the gas inlet.

7. The adapter according to claim 1 wherein the stem is elongated and has a longitudinal axis and the passage has a first portion aligned with the longitudinal axis.

8. The adapter according to claim 7 wherein the passage comprises a lateral portion extending from the first portion to the exterior of the stem and the intersection of the lateral portion with the first portion defines the passage inlet.

9. The adapter according to claim 1 wherein a tapped opening is formed in the upper end of the stem.

10. The adapter according to claim 9 wherein the stem has a height such that the upper end of the stem is adapted to abut a portion of the manifold when the manifold is seated on the adapter manifold seat to permit a fastener to be threaded into the tapped opening to secure the adapter to the manifold.

11. The adapter according to claim 10 wherein the tapped opening forms an upper portion of the passage.

12. The adapter according to claim 1 and further comprising a gasket encircling the stem whereby the gasket is adapted to be compressed between the manifold and the adapter when the manifold is seated in the adapter manifold seat to form a seal therebetween.

13. The adapter according to claim 1 and further comprising a second gasket encircling the outlet opening of the passage and in abutting relationship with the first portion of the lower surface whereby the second gasket is adapted to be compressed between the adapter lower surface and the valve manifold seat when the adapter first portion is seated within the valve seat to form a seal therebetween.

14. A cooktop comprising:

a burner having an inlet and an outlet for dispensing gas to generate a cooking flame;

a valve having an outlet coupled to the burner inlet, a manifold seat with a first profile, and an inlet opening formed in the valve manifold seat; a manifold for supplying gas to the valve and having a contact surface with a second profile and in which is formed an outlet opening; and an adapter coupling the gas valve to the manifold comprising:

a body having an upper surface and a lower surface, the lower surface having a first portion with a profile corresponding to the first profile of the gas valve manifold seat, the upper surface having a manifold seat with a profile corresponding to the second profile of the manifold contact surface;

a stem located in the manifold seat of the upper surface and extending therefrom to terminate in an upper end;

a passage extending through the body and having an inlet opening formed in the stem and an outlet opening formed in the first portion;

wherein the adapter couples the manifold to the valve by the first portion of the adapter lower surface being seated on the valve manifold seat and the manifold contact surface being seated on the manifold seat of the adapter upper surface.

15. The cooktop according to claim 14 wherein the profile of the first portion is non-planar.

16. The cooktop according to claim 15 wherein the profile of the manifold seat is planar.

17. The adapter according to claim 16 wherein the non-planar profile is arcuate.

18. The adapter according to claim 14 wherein the passage outlet is adapted to mate with the gas inlet.

19. The adapter according to claim 18 wherein the passage outlet is sized to receive a stem extending from the valve and in which is defined the gas inlet for the valve to thereby effect the mating of the passage outlet and the gas inlet.

20. The adapter according to claim 19 wherein the stem is elongated and has a longitudinal axis and the passage has a first portion aligned with the longitudinal axis.

21. The adapter according to claim 20 wherein the passage comprises a lateral portion extending from the first portion to the exterior of the stem and the intersection of the lateral portion with the first portion defines the passage inlet.

22. The adapter according to claim 21 wherein a tapped opening is formed in the upper end of the stem.

23. The adapter according to claim 22 wherein the stem has a height such that the upper end of the stem abuts a portion of the manifold when the manifold is seated on the adapter manifold seat to permit a fastener to be threaded into the tapped opening to secure the adapter to the manifold.

24. The adapter according to claim 14 and further comprising a gasket encircling the stem whereby the gasket is compressed between the manifold and the adapter when the manifold is seated in the adapter manifold seat to form a seal therebetween.

25. The adapter according to claim 15 and further comprising a second gasket encircling the outlet opening of the passage and in abutting relationship with the first portion of the lower surface whereby the second gasket is compressed between the adapter lower surface and the valve manifold seat when the adapter first portion is seated within the valve seat to form a seal therebetween.

* * * * *